US006948965B2

(12) United States Patent
Kumamoto et al.

(10) Patent No.: US 6,948,965 B2
(45) Date of Patent: Sep. 27, 2005

(54) BALANCED TRANSMISSION CABLE CONNECTOR

(75) Inventors: Tadashi Kumamoto, Shinagawa (JP); Mitsuru Kobayashi, Shinagawa (JP); Hideo Miyazawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/974,683

(22) Filed: Oct. 28, 2004

(65) Prior Publication Data

US 2005/0181670 A1 Aug. 18, 2005

(30) Foreign Application Priority Data

Feb. 13, 2004 (JP) ..... 2004-036907

(51) Int. Cl.[7] ..... H01R 13/627
(52) U.S. Cl. ..... 439/358; 439/607
(58) Field of Search ..... 439/357, 358, 439/352, 353, 607, 76.1, 497, 608

(56) References Cited

U.S. PATENT DOCUMENTS 6,364,687 B1 * 4/2002 Chen ..... 439/358
6,786,763 B2 * 9/2004 Wu ..... 439/497
6,860,748 B2 * 3/2005 Ohtani et al. ..... 439/352

FOREIGN PATENT DOCUMENTS

JP 2003-59593 2/2003

* cited by examiner

*Primary Examiner*—Tho D. Ta
(74) *Attorney, Agent, or Firm*—Staas & Halsey LLP

(57) ABSTRACT

A balanced transmission cable connector is disclosed. The balanced transmission cable connector includes a contact assembly, a shield cover assembly, an outer cover assembly, a lock mechanism, and a lock release mechanism. An end of a balanced transmission cable is connected to the balanced transmission cable connector. The lock mechanism is provided on the contact assembly and is located inside the shield cover assembly. The lock mechanism has hooks that protrude in the height direction of the balanced transmission cable connector. The lock release mechanism is formed by an operations portion that is part of the outer cover assembly.

4 Claims, 13 Drawing Sheets

BALANCED TRANSMISSION CABLE CONNECTOR

BACKGROUND OF THE INVENTION

The present invention generally relates to balanced transmission cable connectors, and, more particularly, to a balanced transmission cable connector to be applied to a balanced transmission cable having a small number of electric wire pairs.

There are two types of data transmission methods. One is a normal transmission method utilizing one electric wire for each set of data, and the other one is a balanced transmission method utilizing a pair of electric wires for each set of data. By the balanced transmission method, a positive signal and a negative signal, which has the same size as the positive signal but is directed in the opposite direction from the positive signal, are transmitted at the same time. Compared with the normal transmission method, the balanced transmission method is advantageous in not easily being adversely influenced by noise, and is being more widely employed. A balanced transmission cable connector is used to form a path for performing balanced transmission of data between two apparatuses. Such a balanced transmission cable connector has a structure in which a shielded connector is attached to the end of a balanced transmission cable.

Since the amount of data to be transmitted between a computer and a server is very large, a balanced transmission cable connector that connects the computer and the server is large-sized and is connected to the end of a thick balanced transmission cable that has ten or more electric wire pairs. This connector includes a lock mechanism for securing the connector to a socket of a computer and maintaining the connection of the connector to the socket, and a lock release mechanism for releasing the lock when the connector is pulled out of the socket.

In recent years, balanced transmission has been employed for apparatuses such as digital copying machines with which only a small amount of data is involved. Along with this trend, there is an increasing demand for balanced transmission cable connectors that can be used to connect such apparatuses.

In a case of employing a balanced transmission cable connector to be used in an apparatus with which only a small amount of data transmission is involved, the socket provided on the apparatus needs to be small-sized, there should be only a few of electric wire pairs, and the connector main body including the lock mechanism and the lock release mechanism should be smaller in size than a conventional one.

FIGS. 1 and 2 illustrate a conventional balanced transmission cable connector 10 that is used to connect a computer and a server. In FIGS. 1 and 2, the directions X1-X2, Y1-Y2, and Z1-Z2 represent the width direction, the longitudinal direction, and the height direction, respectively, of the balanced transmission cable connector 10. The Y1 side is the back side, and the Y2 side is the front side. In the balanced transmission cable connector 10, a contact assembly 11 and an end of a balanced transmission cable 12 are covered with a shield cover 15 that is formed by combining die-cast half shield covers 13 and 14. In FIGS. 1 and 2, the half shield cover 13 is located above the half shield cover 14. Lock members 16 and 17 are provided on two side portions aligned in the width direction of the cable connector 10, and are located outside the shield cover 15. A pull tab 18 having a lock releasing function is provided on the side of the shield cover 15 from which the balanced transmission cable 12 extends.

The conventional transmission cable connector 10 cannot be made small in size, because the lock members 16 and 17 are located outside the shield cover 15 and are provided on the two side portions of the cable connector 10 aligned in the width direction, the pull tab 18 with the lock releasing function is located on the side of the shield cover 15 from which the balanced transmission cable 12 extends, and the half shield covers 13 and 14 are made of a die-cast material.

SUMMARY OF THE INVENTION

A general object of the present invention is to provide balanced transmission cable connectors in which the above disadvantages are eliminated.

A more specific object of the present invention is to provide a balanced transmission cable connector that is smaller in size than a conventional balanced transmission cable connector.

The above objects of the present invention are achieved by a balanced transmission cable connector that includes: a contact assembly that has first and second signal contacts in pairs and ground contacts alternately arranged in an insulating block body; and a shield cover assembly that is formed from a metal plate and surrounds the contact assembly and an end portion of a balanced transmission cable electrically connected to the first and second signal contacts and the ground contacts of the contact assembly. By surrounding the contact assembly and the end portion of the balanced transmission cable electrically connected to the first and second signal contacts and the ground contacts in this balanced transmission cable connector, the shield cover assembly forms a connector main body. A side portion of the connector main body on which the balanced transmission cable extends is covered with an insulating outer cover. The top end of the connector main body that is not covered with the outer cover is inserted into and connected to a socket. A lock mechanism is formed on the contact assembly and located inside the shield cover assembly. The lock mechanism secures the balanced transmission cable connector to the socket, when the balanced transmission cable connector is connected to the socket. A lock release mechanism is formed on part of the outer cover. The lock release mechanism releases the lock, when the balanced transmission cable connector is pulled out of the socket.

In accordance with the present invention, the lock mechanism can be incorporated into a cable connector main body, without making the cable connector bulky, because the lock mechanism is formed on the contact assembly and is located inside the shield cover assembly. Also, since the lock release mechanism is part of the outer cover, the lock mechanism can be incorporated into the main body, without making the cable connector bulky.

The balanced transmission cable connector according to the present invention can be used for a signal transmission path between a digital copying machine and peripheral equipment, for example.

The above and other objects and features of the present invention will become more apparent from the following description taken in conjunction with the accompanying drawings.

DESCRIPTION OF THE PREFERRED EMBODIMENTS

The following is a description of embodiments of the present invention, with reference to the accompanying drawings.

Figure 8A:
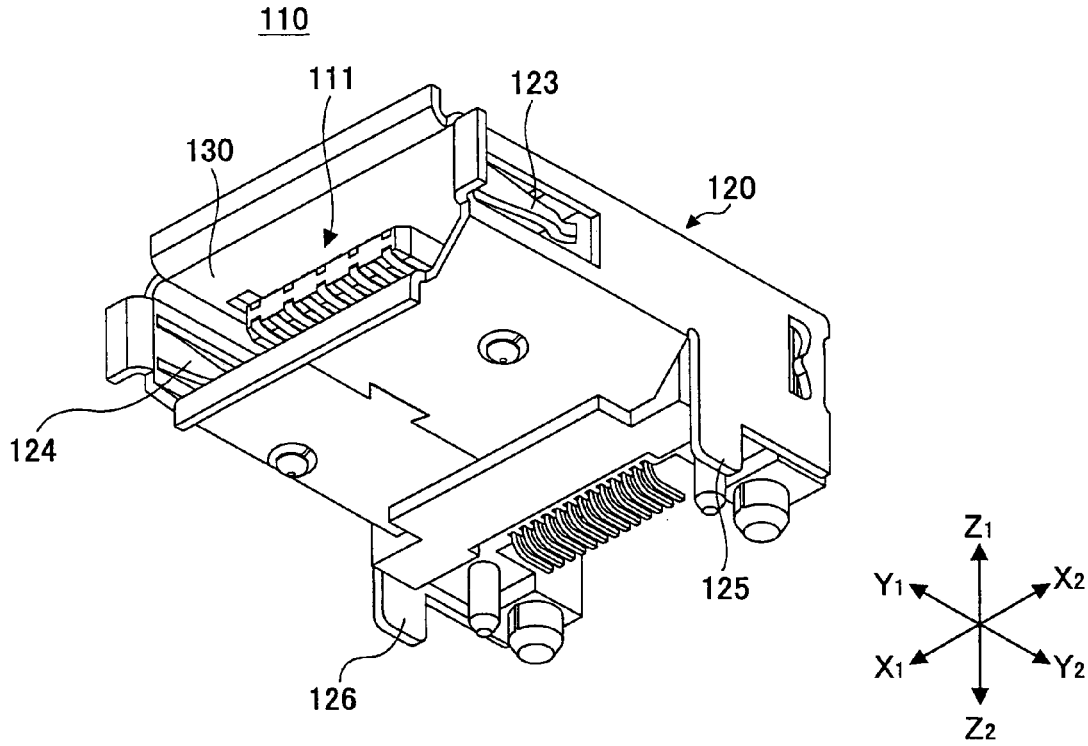
FIGS. 8A and 8B are perspective views of a socket.
Figure 10:
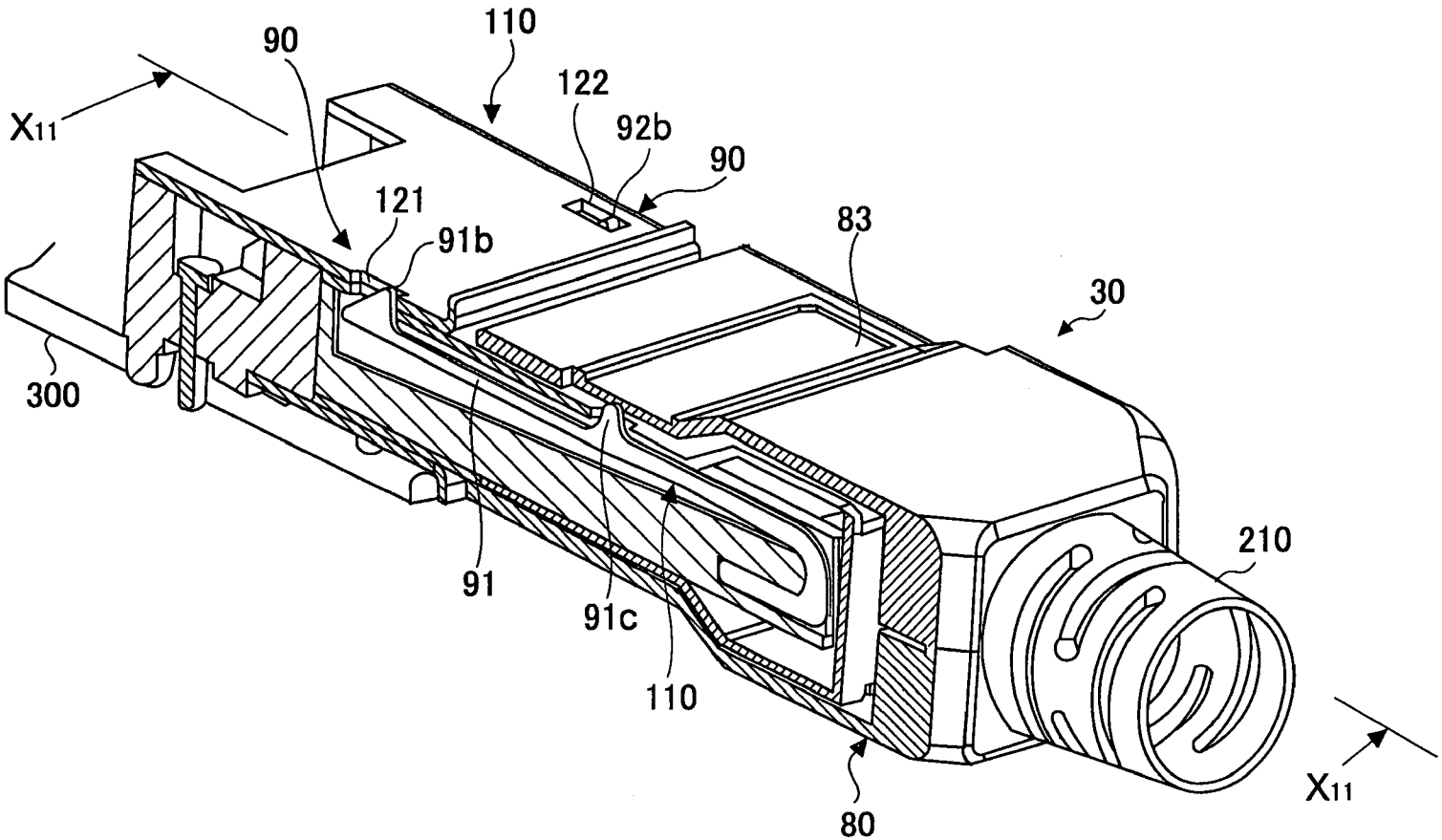
FIG. 10 is a partially cutaway, perspective view of the balanced transmission cable connector connected to the socket.
Figure 11:
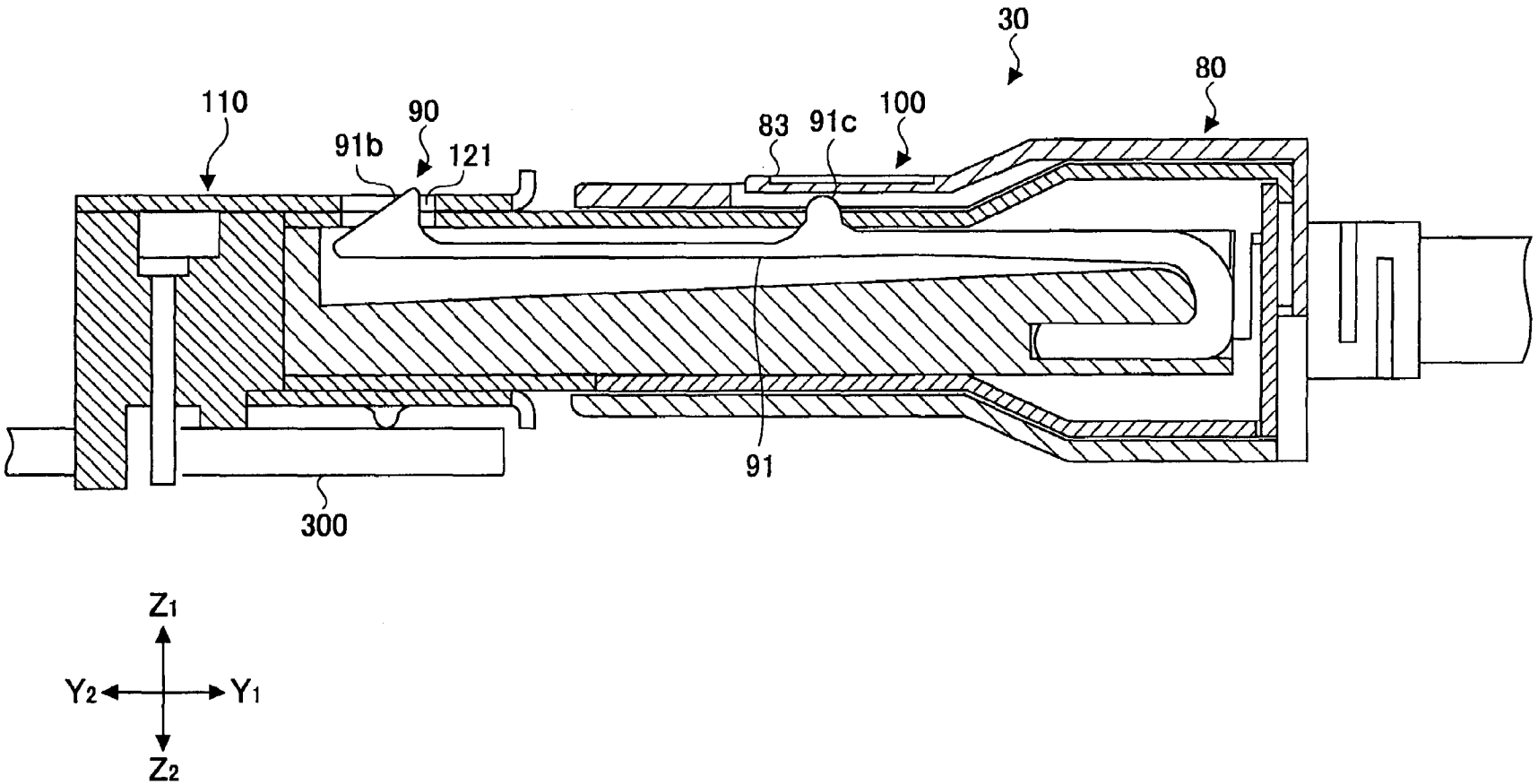
FIG. 11 shows the cross section of the balanced transmission cable connector connected to the socket shown in FIG. 10.
Figure 12:
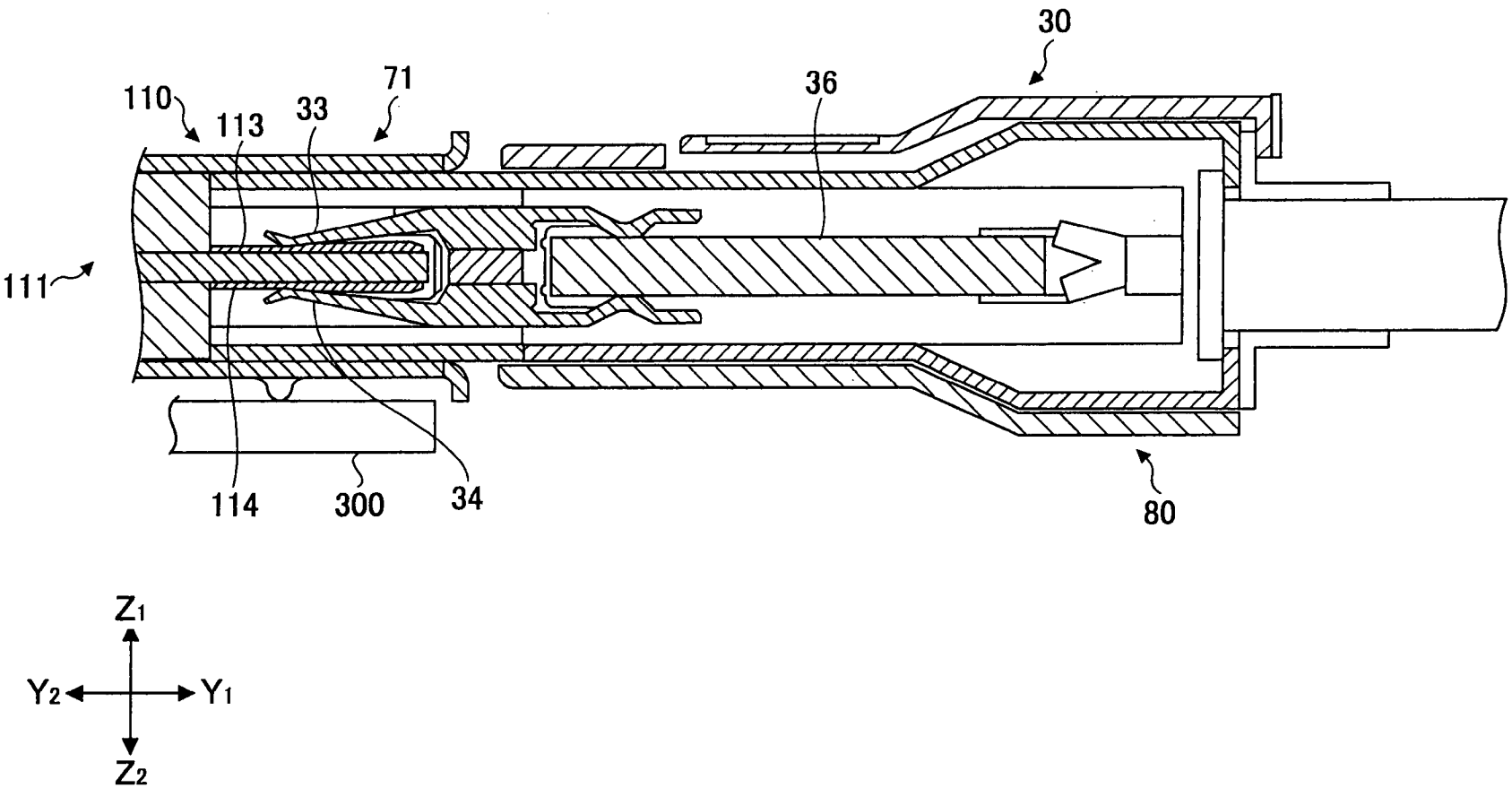
FIG. 12 is a cross-sectional view of the balanced transmission cable and the socket, taken along the line XII—XII of FIG. 10.

FIGS. 3 through 6 illustrate a balanced transmission cable connector 30 in accordance with a first embodiment of the present invention. FIGS. 8A through 9 illustrate a socket 110. FIGS. 10 through 12 illustrate a situation in which the cable connector 30 is connected to the socket 110. In the figures, X1-X2, Y1-Y2, and Z1-Z2 represent the width direction, the longitudinal direction, and the height direction, respectively, of the cable connector 30 and the socket 110. The directions Y1-Y2 are also the insertion and removing directions of the cable connector 30 with respect to the socket 110. The Y1 side represents the back side of the cable connector 30, while the Y2 side represents the front side of the cable connector 30.

Figure 7:
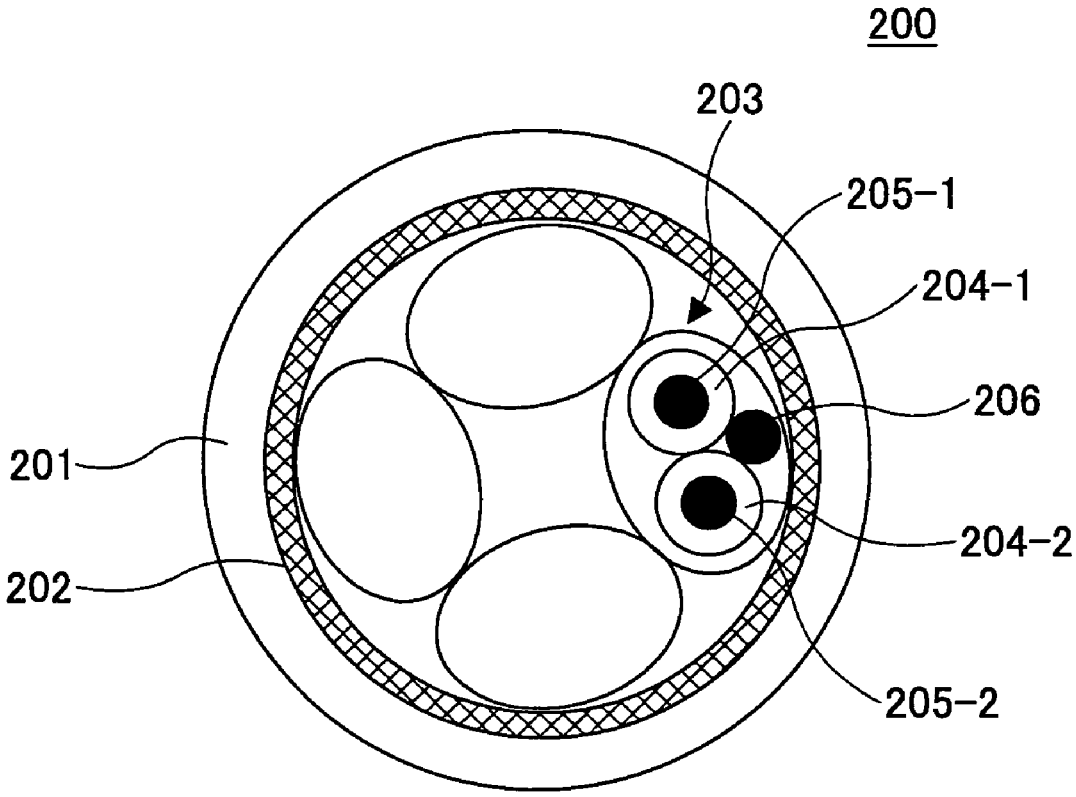
FIG. 7 is a cross-sectional view of a balanced transmission cable.

The cable connector 30 is used to connect a digital copying machine and peripheral equipment, for example. The balanced transmission cable 200 of the cable connector 30 is thin as shown in FIG. 7, and is to be inserted into the socket 110 mounted on a circuit board in the digital copying machine, as shown in FIGS. 10 through 12.

The socket 110 is described first, for ease of explanation.

Figure 8B:
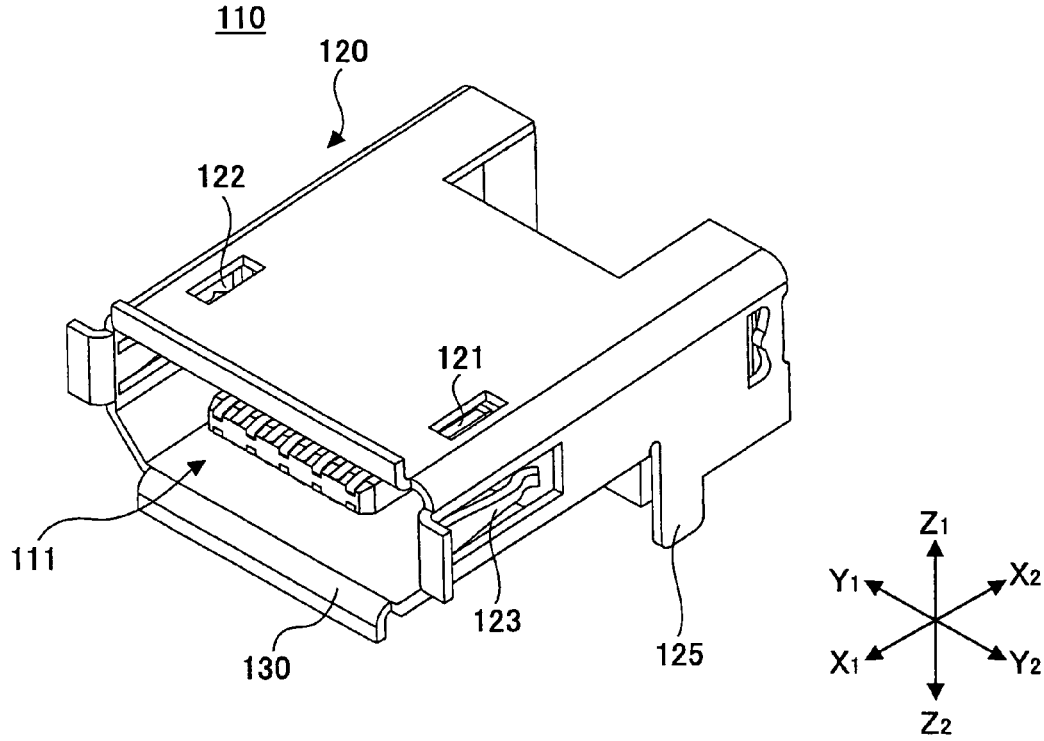
Figure 9:
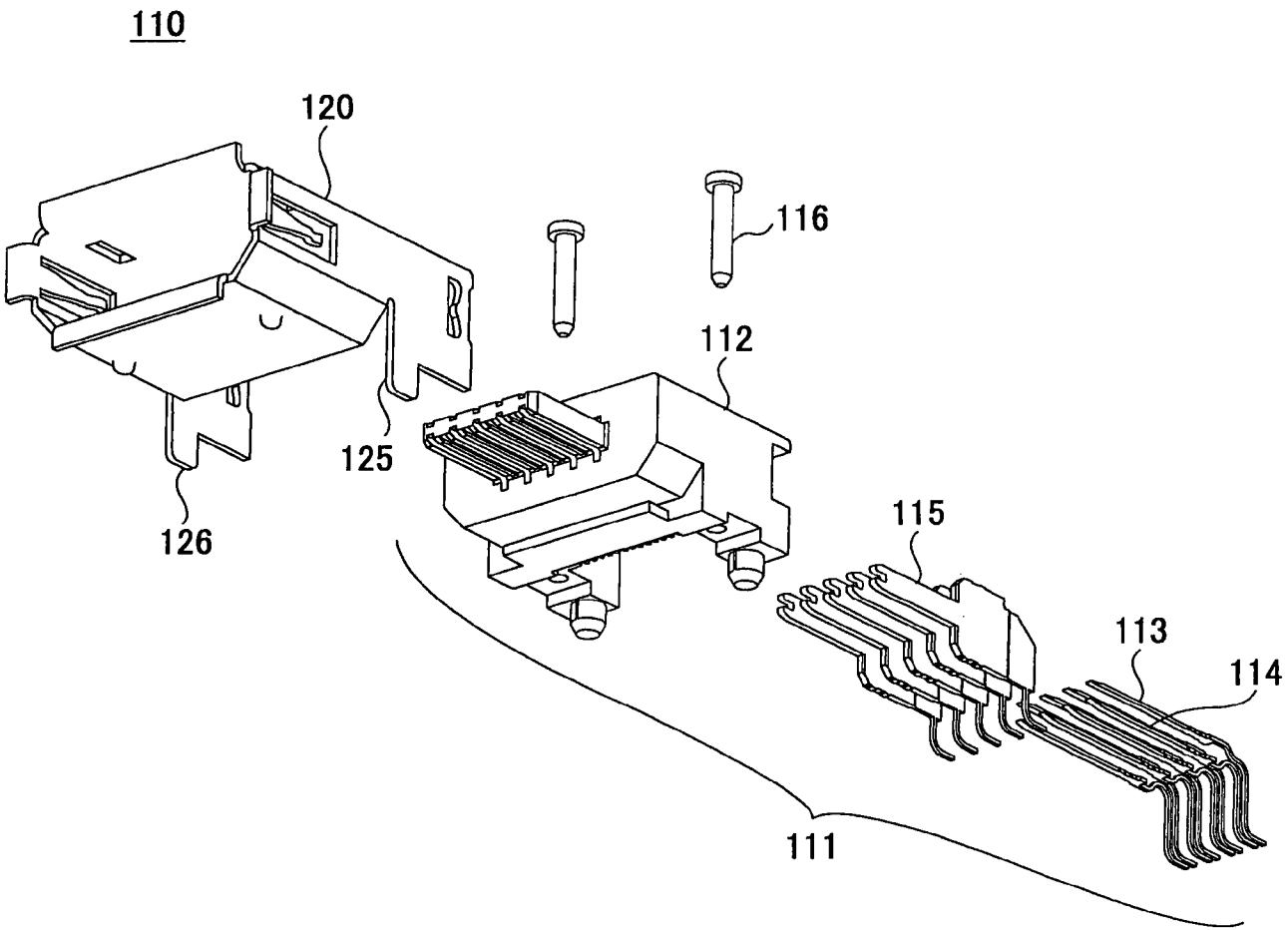
FIG. 9 is an exploded perspective view of the socket of FIGS. 8A and 8B.

As shown in FIGS. 8A and 8B and FIG. 9, the socket 110 has a contact assembly 111 surrounded by a shield cover 120, and also has an insertion opening 130 formed on the Y1 side. The cable connector 30 is to be inserted into the insertion opening 130. The contact assembly 111 includes first and second signal contacts 113 and 114 in pairs and plate-like ground contacts 115 that are alternately arranged and incorporated into an insulating block body 112. Also, a pair of solder-fixing pins 116 is inserted into the block body 112. The shield cover 120 is a metal plate that surrounds the contact assembly 111. The shield cover 120 has locking openings 121 and 122 formed apart from each other on the upper surface. The shield cover 120 also has contact portions 123 and 124 formed on the side surfaces, and mounting leg portions 125 and 126 formed on both sides of the bottom surface. As shown in FIGS. 10 and 11, the socket 110 is mounted on an end of a circuit board 300 in the apparatus through the solder-fixing pins 116, the mounting leg portions 125 and 126, and others. In this structure, the ends of the first and second signal contacts 113 and 114 are soldered to the pad on the circuit board 300.

Next, the balanced transmission cable connector 30 is described.

As shown in FIGS. 3, 4, 5A, and 5B, the balanced transmission cable connector 30 includes a contact assembly 31, a shield cover assembly 50, an outer cover assembly 80, a lock mechanism 90, and a lock release mechanism 100. The end of the balanced transmission cable 200 is connected to the balanced transmission cable connector 30. The features of the cable connector 30 include that the lock mechanism 90 is provided on the contact assembly 31 within the shield cover assembly 50, that hook portions 91*b* and 92*b* protrude in the Z1 direction, and that the lock release mechanism 100 is part of the outer cover assembly 80.

Figure 1:
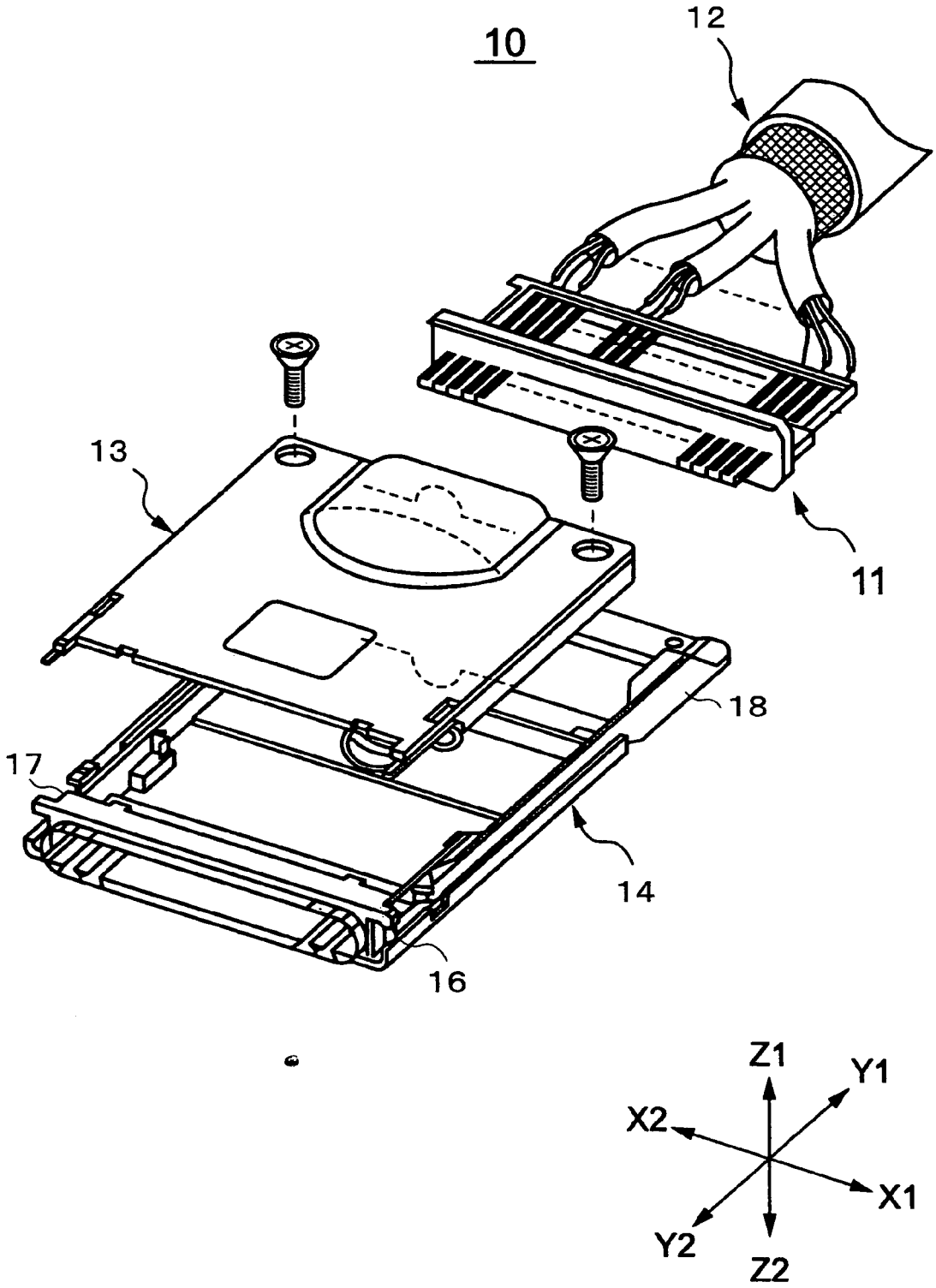
FIG.1 PRIOR ART
FIG. 1 is an exploded perspective view of a conventional balanced transmission cable connector.
Figure 2:
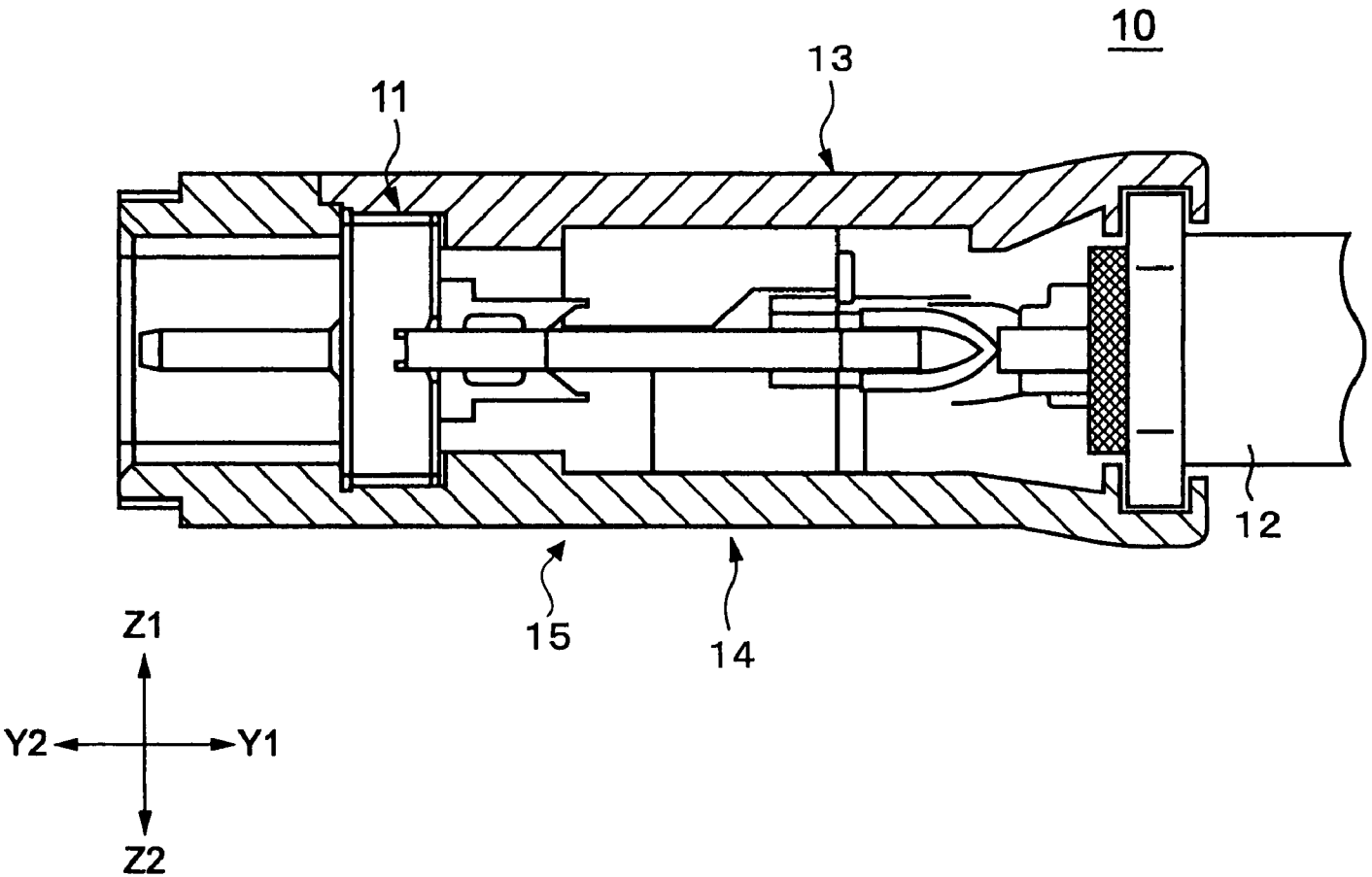
FIG.2 PRIOR ART
FIG. 2 is a cross-sectional view of the balanced transmission cable connector of FIG. 1.
Figure 3:
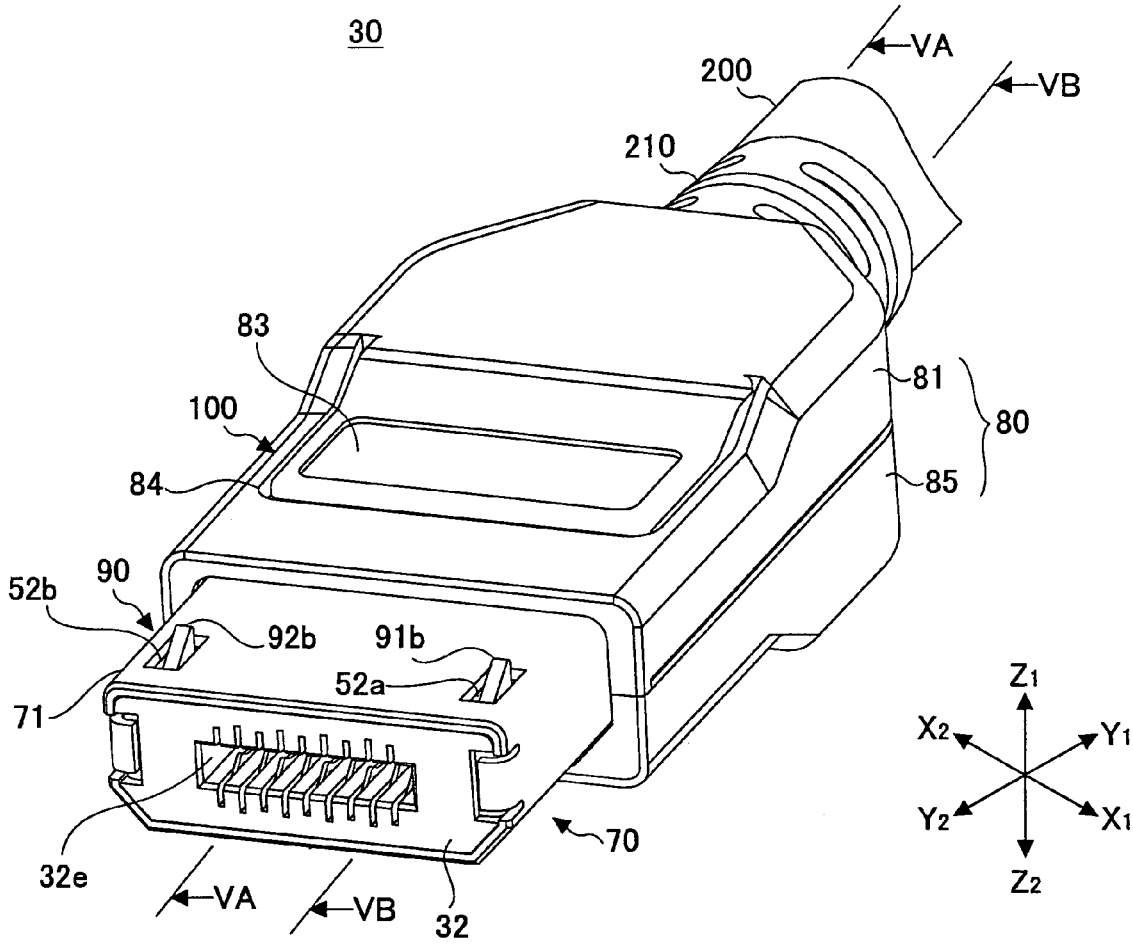
FIG. 3 is a perspective view of a balanced transmission cable connector in accordance with a first embodiment of the present invention.
Figure 6:
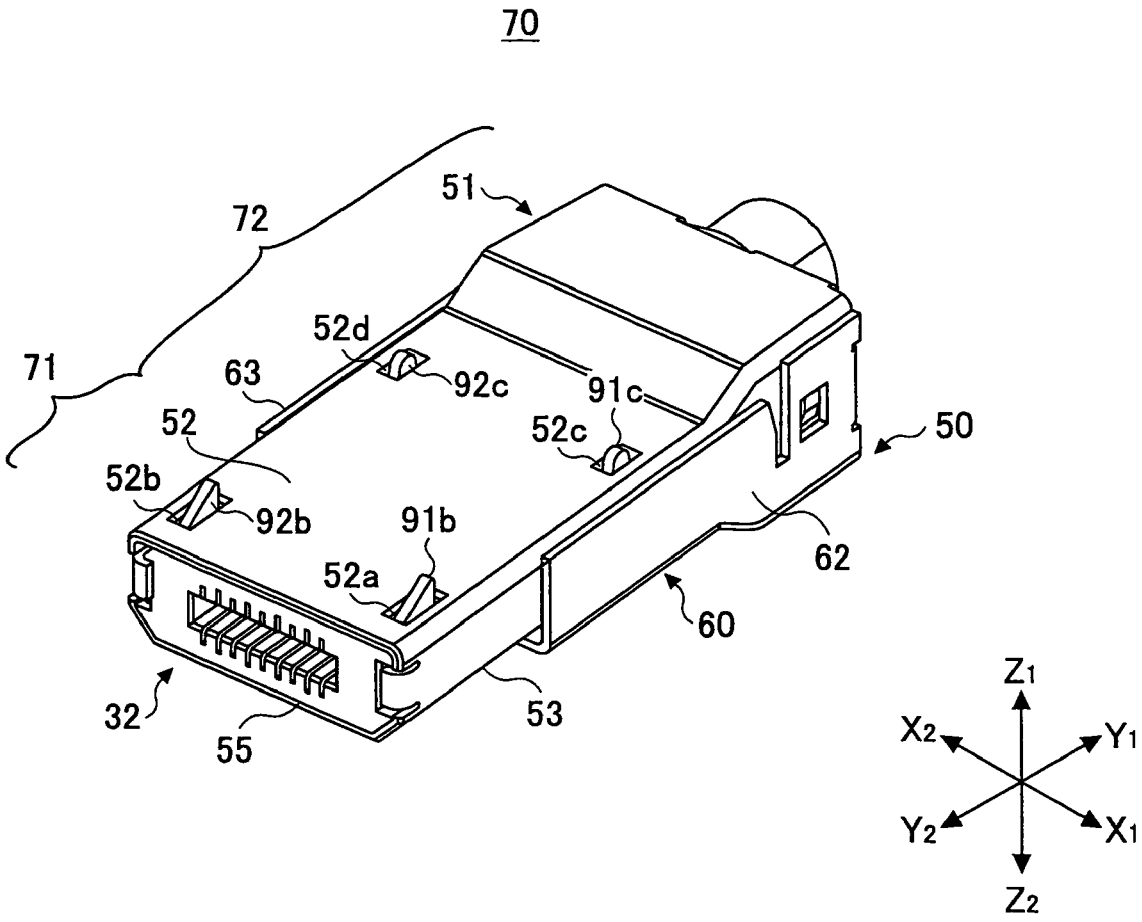
FIG. 6 illustrates the connector main body shown in FIG. 3.

A connector main body 70 shown in FIG. 6 has the shield cover assembly 50 surrounding the contact assembly 31 and the end of the balanced transmission cable 200. Reference numeral 71 indicates the engaging portion that is to be inserted into the socket 110 and is located on the Y2 side. Reference numeral 72 indicates a portion to be surrounded by the outer cover assembly 80. The outer cover assembly 80 is to be attached to the connector main body 70, and has such a shape that a user can easily hold the outer cover assembly 80 with fingers. As shown in FIG. 3, the engaging portion 71 protrudes in the Y2 direction from the outer cover assembly 80, and is exposed to the outside.

Figure 5A:
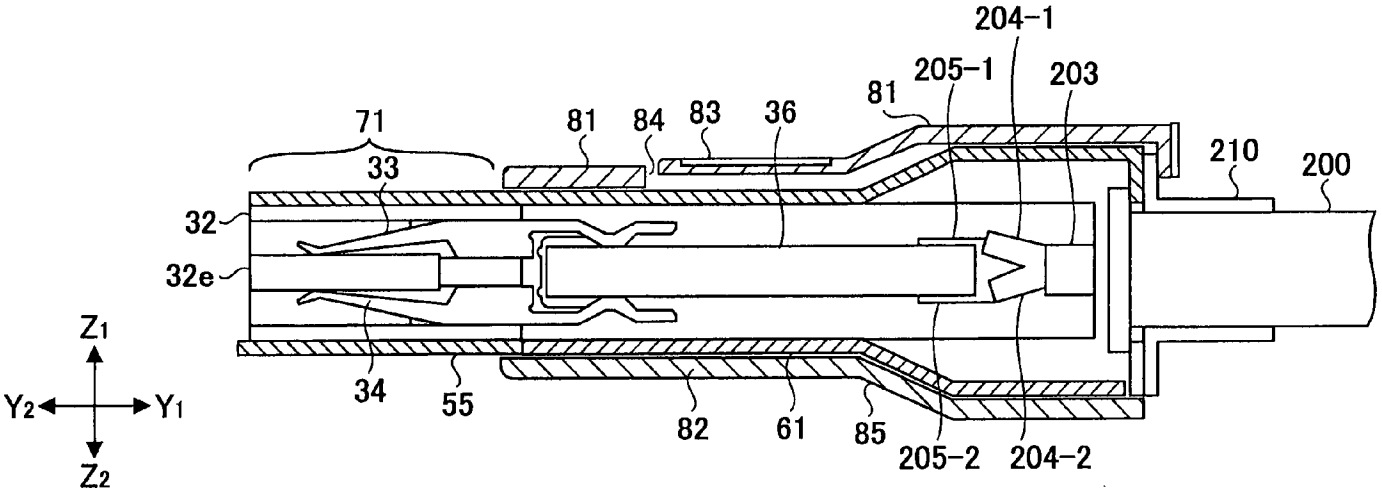
FIGS. 5A and 5B are VA—VA and VB—VB cross-sectional views of the balanced transmission cable connector of FIG. 3, respectively.

The balanced transmission cable 200 is a thin cable having four electric wire pairs 203 contained in a double-layer tube that is made up of an outer coating 201 and a shielding screen wire 202, as shown in FIG. 7. Each of the electric wire pairs 203 includes first and second coated signal wires 204-1 and 204-2 and a drain wire 206 tied with spirally wound metallic tape. As shown in FIG. 5A, the first and second coated signal wires 204-1 and 204-2 and the drain wire 206 extend from each of the pair electric wires 203. The coating is removed at the ends of the first and second coated signal wires 204-1 and 204-2, so that first and second thin signal wires 205-1 and 205-2 of 0.3 mm in diameter are exposed. The first and second signal wires 205-1 and 205-2 form a wire pair.

Figure 4:
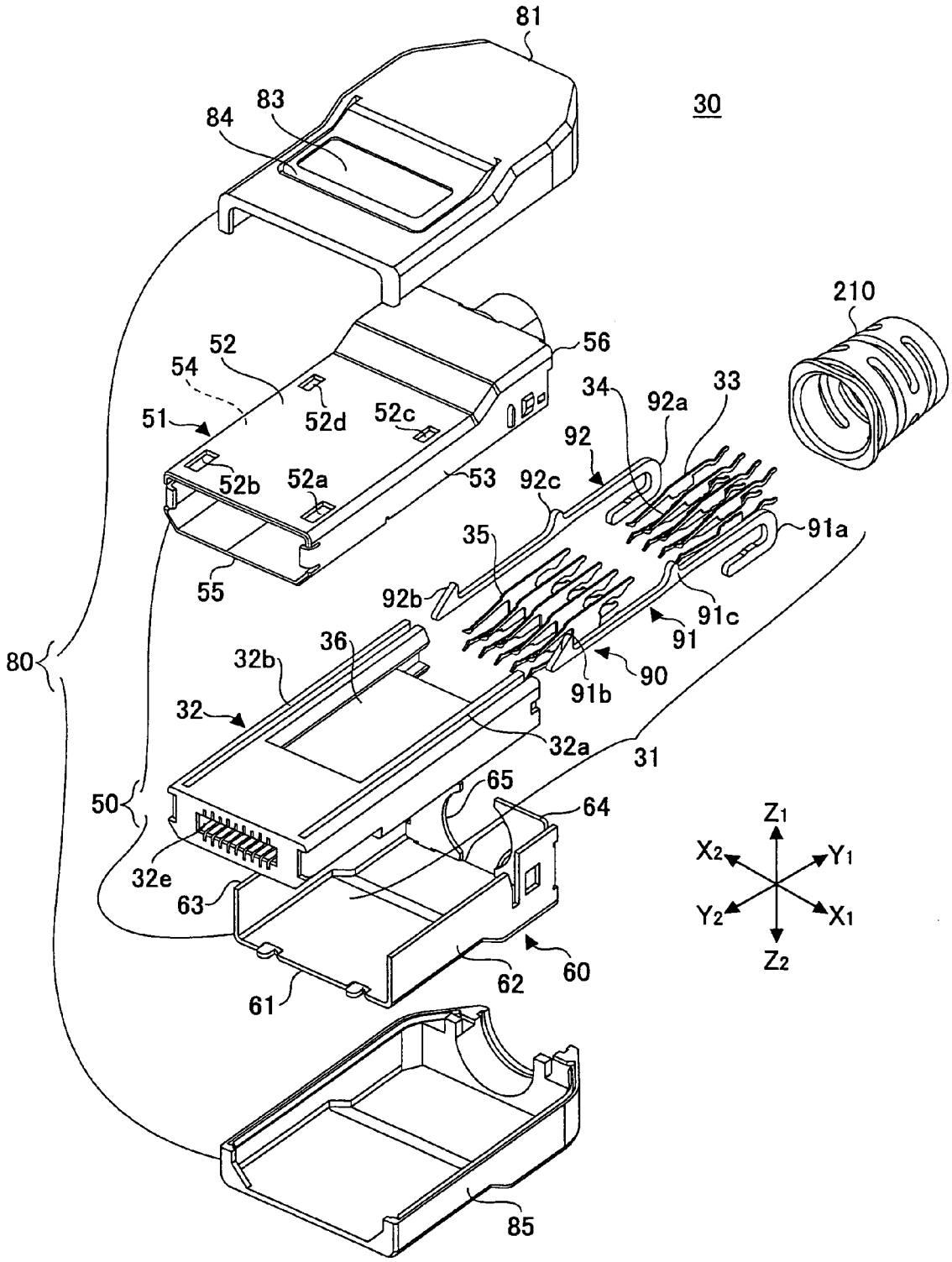
FIG. 4 is an exploded perspective view of the balanced transmission cable connector of FIG. 3.

As shown in FIGS. 4 and 5A, the contact assembly 31 is made of an insulating synthetic resin, and has first and second signal contacts 33 and 34 in pairs and fork-like ground contacts 35 that are alternately arranged in the X direction and are inserted into a block body 32. The block body 32 is a flat, rectangular parallelepiped structure. A relay board 36 that is soldered to the signal contacts 33 and 34 and the ground contacts 35 is also inserted into the block body 32 on the Y1 side. The electric wire pairs 203 at the end of the balanced transmission cable 200 that is inserted through a protection tube 210 are adjusted so that the first and second signal wires 205-1 and 205-2 and the drain wires 206 are soldered to the pad at the Y1-side end of the relay board 36. An opening 32*e* is formed at the Y2-side end of the block body 32, and the signal contacts 33 and 34 and the ground contacts 35 are exposed through the opening 32*e*.

As shown in FIG. 4, the shield cover assembly 50 is formed by combining a first shield cover 51 and a second shield cover 60. The first shield cover 51 and the second shield cover 60 are both metal plates. The first shield cover 51 is formed by press-molding a metal plate, and has a sleeve-like structure with a rectangular cross section. This first shield cover 51 includes an upper surface plate 52, left and right side surface plates 53 and 54, a lower surface plate 55 that occupies the Y1-side half of the bottom area of the first shield cover 51, and a Y1-side back surface plate 56. The second shield cover 60 is also formed by press-molding a metal plate, and has a U-shaped structure. This second shield cover 60 includes a bottom plate 61, left and right side surface plates 62 and 63, and a Y1-side back surface plate 64. A circular opening 65 through which the balanced transmission cable 200 is to be inserted is formed in the back surface plate 64.

As shown in FIGS. 6 and 5A, the Y2 side of the contact assembly 31 is inserted into the first shield cover 51, so that the contact assembly 31 is accommodated under the first shield cover 51. The second shield cover 60 is combined with the first shield cover 51 from the Z2 side, so that the second shield cover 60 covers the Y1-side half of the Z2-side surface of the contact assembly 31. The side surface plates 62 and 63 overlap the side surface plates 53 and 54, respectively, and are located outside the side surface plates 53 and 54. The first shield cover 51 and the second shield cover 60 are combined to cover the contact assembly 31, thereby forming the connector main body 70 shown in FIG. 6. The connector main body 70 shields the first and second signal contacts 33 and 34, the ground contacts 35, and the first signal wires 205-1, the second signal wires 205-2, and the drain wires 206 that extend from the end of the balanced transmission cable 200.

Small openings 52*a* and 52*b* are formed on the X1 and X2 sides, respectively, of the upper surface plate 52 of the first shield cover 51. The openings 52*a* and 52*b* are located close to the Y2 end of the upper surface plate 52 of the first shield cover 51. Further, small openings 52*c* and 52*d* are formed on the X1 and X2 sides, respectively, of the middle portion of the upper surface plate 52 of the first shield cover 51. The openings 52*a* and 52*b* are part of the engaging portion 71, while the openings 52*c* and 52*d* are part of the portion 72.

The outer cover assembly 80 is formed by assembling an upper half cover 81 and a lower half cover 85 that are molded components of an insulating synthetic resin. More specifically, the upper half cover 81 is placed onto the lower half cover 85, and the joining portion between the upper half cover 81 and the lower half cover 85 is ultrasonically welded, thereby forming the outer cover assembly 80. The outer cover assembly 80 covers the portion 72 on the Y1 side, and supports the end of the protection tube 210.

As shown in FIG. 4, the lock mechanism 90 includes a pair of lock arm members 91 and 92. The lock arm members 91 and 92 are thin, long plate-like metal components. The lock arm members 91 and 92 respectively include U-shaped portions 91*a* and 92*a* on the Y1-side ends, the hooks 91*b* and 92*b* that are right triangles protruding in the Z1 direction from the Y2-side ends, and protrusions 91*c* and 92*c* protruding in the Z1 direction from the middle portions. The U-shaped portion 91*a* (92*a*), the protrusion 91*c* (92*c*), and the hook 91*b* (92*b*) are located on one straight line.

Grooves 32*a* and 32*b* that extend in the Y direction are formed on the X1 and X2 sides, respectively, of the upper surface of the block body 32. The opening 32*e* is formed on the Y2-side end of the block body 32. The groove 32*a* reaches the Y1-side end of the block body 32. The side portion of the block body 32 below the groove 32*a* on the Y1-side forms a stopper 32*d*. The groove 32*a* is deeper at the Y2 side than at the Y1 side. The groove 32*b* on the X2 side has the same structure as the groove 32*a* on the X1 side.

The lock arm member 91 is inserted into the groove 32*a* and the U-shaped portion 91*a* is engaged with the stopper 32*d*. In this manner, the Y1 side of the lock arm member 91 is tightly secured and housed in the groove 32*a*. The hook 91*b* on the free end of the lock arm member 91 protrudes in the Z1 direction from the opening 52*a*, and the protrusion 91*c* protrudes in the Z1 direction from the opening 52*c*. There is a space 58 formed between the lock arm member 91 and the bottom of the groove 32*a*, and accordingly, the lock arm member 91 can elastically bend in the Z2 direction. The lock arm member 92 is also housed in the groove 32*b* in the same manner as the lock arm member 91, and the hook 92*b* and the protrusion 92*c* protrude from the openings 52*b* and 52*d*, respectively, in the Z1 direction that is perpendicular to the aligning direction of the contacts.

In the above manner, the lock mechanism 90 is incorporated into the connector main body 70 by utilizing the X1 and X2 sides of the block body 32. In the connector main body 70, the lock mechanism 90 is located inside the shield cover assembly 50. As the hooks 91*b* and 92*b* protrude in the Z1 direction from the connector main body 70, the lock mechanism 90 can be incorporated into the connector main body 70 without making the entire structure bulky.

Figure 5B:
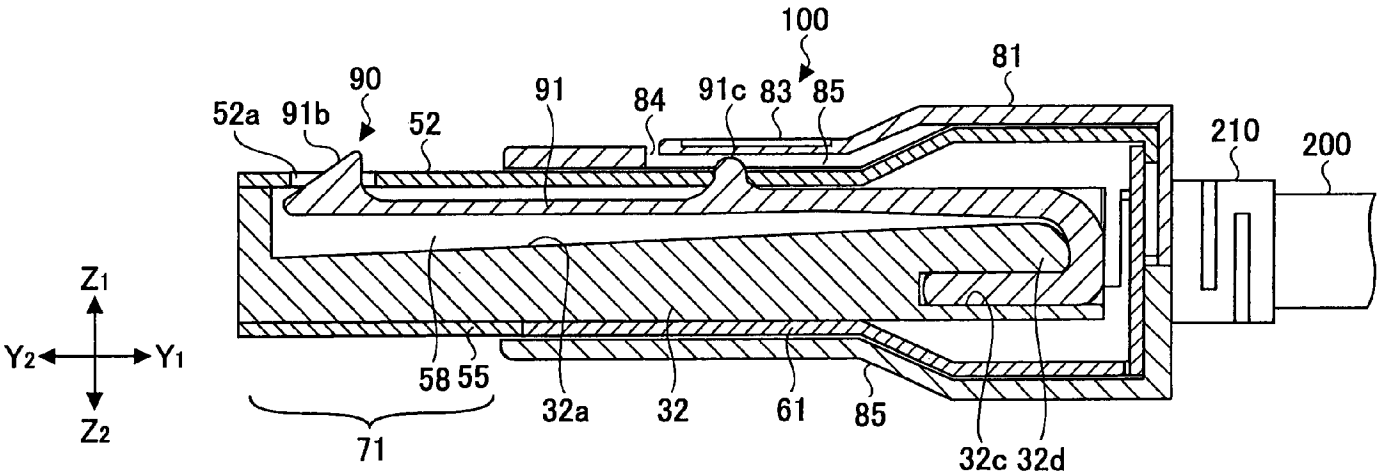

As shown in FIGS. 3, 4, and 5B, the lock release mechanism 100 includes the protrusions 91*c* and 92*c* protruding from the openings 52*c* and 52*d*, respectively, and an operations portion 83 that is part of the upper half cover 81. The operations portion 83 can bend, and is surrounded by a U-shaped slit 84 of the upper half cover 81. The operations portion 83 is large enough to cover both of the protrusions 91*c* and 92*c*. The operations portion 83 is located at a short distance from the upper surface of the shield cover assembly 50, so that a space 85 is formed between the lower surface of the operations portion 83 and the upper surface of the shield cover assembly 50. With the space 85, the operations portion 83 can elastically bend in the Z2 direction. Also, the lower surface of the operations portion 83 can push the protrusions 91*c* and 92*c*.

In this structure, the operations portion 83 is part of the upper half cover 81, and there is no need to add a mechanism for transferring each movement of the operations portion 83 to the protrusions 91*c* and 92*c*. Accordingly, the lock release mechanism 100 can be made simple and not bulky.

As the lock mechanism 90 and the lock release mechanism 100 are not bulky, the cable connector 30 can also be made small in size.

Next, connection of the cable connector 30 to the socket 110 and disconnection of the cable connector 30 from the socket 110 are described.

As shown in FIGS. 10, 11, and 12, when an operator holds the outer cover assembly 80 with fingers to insert the engaging portion 71 in the Y2 direction into the insertion opening 130 of the socket 110, the contact assembly 111 is engaged with the opening 32*e*, and the signal contacts 33 and 34 are brought into contact with the signal contacts 113 and 114, respectively. At the same time, the ground contacts 35 are brought into contact with the ground contacts 115, and the first shield cover 51 is brought into contact with the contact portions 123 and 124. Thus, the cable connector 30 is electrically connected to the socket 110. Meanwhile, the hooks 91*b* and 92*b* are pushed in the Z2 direction by the shield cover 120 of the socket 110. When reaching the openings 121 and 122, the hooks 91*b* and 92*b* pop up in the Z1 direction and become engaged with the openings 121 and 122, respectively. In this manner, the cable connector 30 is locked and mechanically connected to the socket 110. Also, the lock arm members 91 and 92 are brought into contact with the shield cover 120 of the socket 110, so as to function as ground potential as well as shields.

When the cable connector 30 is connected to the socket 110, the opening 52*a* corresponds to the opening 121 while the opening 52*b* corresponds to the opening 122. In this situation, electromagnetic waves easily leak out. However, the hook 91*b* exists in the openings 52*a* and 121, and partially blocks the openings 52*a* and 121. Likewise, the hook 92*b* partially blocks the openings 52*b* and 122, thereby reducing each opening (gap) to such a size as to restrict propagation of electromagnetic waves. The protrusions 91*c* and 92*c* also partially block the openings 52*c* and 52*d* of the connector main body 70, thereby reducing each opening to such a size as to restrict propagation of electromagnetic waves. In this manner, electromagnetic waves can be prevented from entering the connected cable connector 30 via the openings 121 and 122 and the openings 52*c* and 52*d*. Thus, balanced transmission of data between apparatuses can be smoothly performed, without any adverse influence of noise due to external electromagnetic waves. Also, electromagnetic waves generated in the cable connector 30 can be prevented from leaking out via the openings 121 and 122 and the openings 52*c* and 52*d*.

When the cable connector 30 is to be removed from the socket 110, an operator should hold the outer cover assembly 80 with fingers. When the outer cover assembly 80 is being held with fingers, the operations portion 83 is pushed to bend in the Z2 direction. Then, the operator gently pulls the outer cover assembly 80 in the Y1 direction. Also, the protrusions 91*c* and 92*c* are pushed by the operations portion 83 at the same time, and the lock arm members 91 and 92 elastically bend in the Z2 direction. The hooks 91*b* and 92*b* then retract and become disengaged from the openings 121 and 122, thereby releasing the lock. The cable connector 30 is then pulled out of the socket 110.

Figure 13:
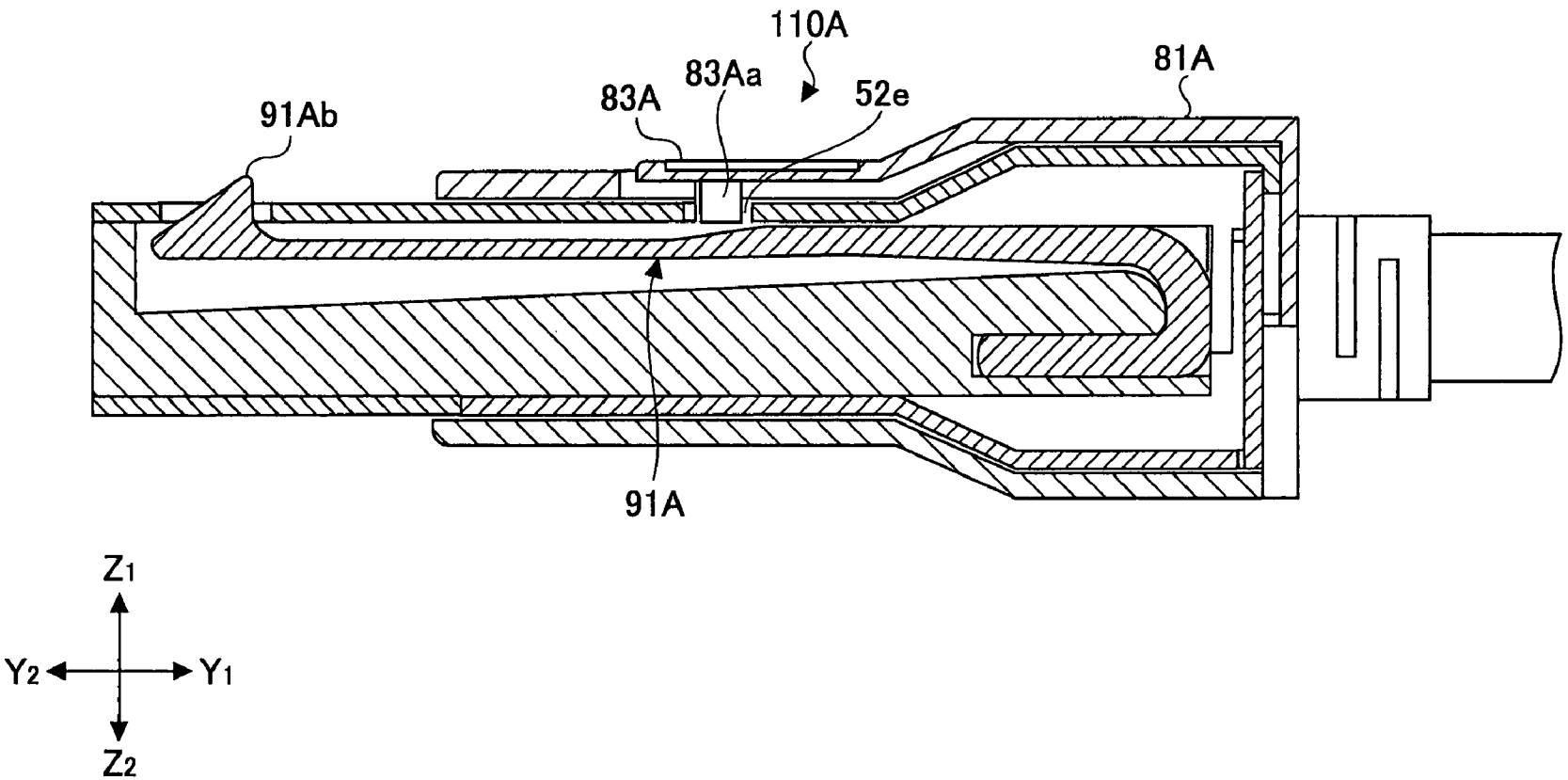
FIG. 13 illustrates another example of the lock release mechanism.

FIG. 13 illustrates another example of the lock release mechanism. A lock release mechanism 110A has conductive protrusions 83Aa under the operations portion 83. The protrusions 83Aa are engaged with the opening 52*c* and 52*d*, and directly face lock arm members 91A and 92A. When the operations portion 83 is pushed down, the protrusions 83Aa push the lock arm members 91A and 92A, which elastically bend.

The lock mechanism 90 may have the hooks 91Ab and 92Ab protruding in the Z1 direction.

The outer cover assembly 80 may also be formed by setting the connector 30 in a resin mold and performing outsert molding.

It should be noted that the present invention is not limited to the embodiments specifically disclosed above, but other variations and modifications may be made without departing from the scope of the present invention.

This patent application is based on Japanese Priority Patent Application No. 2004-036907, filed on Feb. 13, 2004, the entire contents of which are hereby incorporated by reference.

What is claimed is:

1. A balanced transmission cable connector, comprising:

a contact assembly that has first and second signal contacts, in pairs, and ground contacts alternately arranged in an alignment direction in an insulating block body;

a shield cover assembly that is formed from a metal plate and surrounds the contact assembly and an end portion of a balanced transmission cable electrically connected to the first and second signal contacts and the ground contacts of the contact assembly;

the shield cover assembly forming a connector main body by surrounding the contact assembly and the end portion of the balanced transmission cable electrically connected to the first and second signal contacts and the ground contacts;

a side portion of the connector main body, on which the balanced transmission cable extends, being covered with an insulating outer cover;

a top end of the connector main body, that is not covered with the insulating outer cover, being inserted into and connected to a socket;

a lock mechanism formed on the contact assembly and located inside the shield cover assembly, the lock mechanism securing the balanced transmission cable connector to the socket when the balanced transmission cable connector is connected to the socket, the lock mechanism comprising:

a metal lock arm member that has a hook and is bendable, the metal lock arm member being incorporated into an end portion of the insulating block body in the alignment direction, and the hook extending in a direction perpendicular to the alignment direction and protruding from an opening formed in the shield cover assembly; and a lock release mechanism formed on part of the insulating outer cover, the lock release mechanism comprising an elastic portion that is part of the insulating outer cover, to be held by a hand of an operator, and is bendable when pushed, the elastic portion being surrounded by a U-shaped slit formed in the insulating outer cover.

2. The balanced transmission cable connector as claimed in claim 1, wherein:

the lock mechanism further comprises two lock arm members that are bendable, each of the two lock arms having a hook;

the two lock arm members are respectively incorporated into two side portions of an end of the insulating block body, the two side portions being aligned in the alignment direction;

the hooks of the lock arm members extend in a direction perpendicular to the alignment direction, and protrude from openings that are formed on two side portions of the shield cover assembly, the two side portions being aligned in the contact alignment direction; and the formed bendable, when the elastic portion bends, the two lock arm members are pushed by the elastic portion and bend, and the hooks retract into the openings formed in the shield cover assembly.

3. The balanced transmission cable connector as claimed in claim 1, wherein the lock release mechanism has a convex portion formed on part of the lock arm member, the convex portion being pushed by the bottom surface of the elastic portion of the insulating outer cover.

4. The balanced transmission cable connector as claimed in claim 1, wherein the lock release mechanism has a conductive convex portion that pushes the lock arm member, the conductive convex portion being located on the bottom surface of the elastic portion of the outer cover.

* * * * *

UNITED STATES PATENT AND TRADEMARK OFFICE

CERTIFICATE OF CORRECTION

PATENT NO. : 6,948,965 B2
APPLICATION NO. : 10/974683
DATED : September 27, 2005
INVENTOR(S) : Tadashi Kumamoto et al.

It is certified that error appears in the above-identified patent and that said Letters Patent is hereby corrected as shown below:

Column 8, line 48, delete “contact”;

Column 8, line 49, change “formed” to --form--.

Signed and Sealed this

First Day of August, 2006

JON W. DUDAS
*Director of the United States Patent and Trademark Office*